United States Patent [19]

Shook

[11] Patent Number: 4,821,961

[45] Date of Patent: Apr. 18, 1989

[54] SELF-ROTATING NOZZLE

[75] Inventor: Forrest A. Shook, Fenton, Mich.

[73] Assignee: NLB Corp., Wixom, Mich.

[21] Appl. No.: 175,805

[22] Filed: Mar. 31, 1988

[51] Int. Cl.[4] ..... B05B 3/06; B05B 7/02

[52] U.S. Cl. ..... 239/253; 239/254; 239/259; 239/261; 239/526

[58] Field of Search ..... 239/251, 253–261, 239/104, 526, DIG. 13

[56] References Cited

U.S. PATENT DOCUMENTS

| | | | |
|---|---|---|---|
| 1,847,763 | 3/1932 | Keys | 239/251 |
| 2,590,726 | 3/1952 | Sawyer | 239/259 |
| 2,983,452 | 5/1961 | Lindbloom | 239/261 X |
| 3,598,316 | 8/1971 | Johnson | 239/251 |
| 3,623,665 | 11/1971 | Sugino | 239/227 |
| 3,748,050 | 7/1973 | Poppitz | 239/251 |
| 3,858,358 | 1/1975 | Stachowiak | 51/8 |
| 3,885,740 | 5/1975 | Sugino et al. | 239/227 |
| 3,950,045 | 4/1976 | Hart | 384/129 |
| 3,987,963 | 10/1976 | Pacht | 239/252 X |
| 4,030,513 | 6/1977 | McKenzie | 239/251 |
| 4,047,666 | 9/1977 | Hart | 239/251 |
| 4,078,727 | 3/1978 | Lingnau | 239/247 |
| 4,747,544 | 5/1988 | Kränzle | 239/251 |

OTHER PUBLICATIONS

Brochure of United Technologies Elliott of 3240 East National Rd., P.O. Box 239, Springfield, Ohio 45501, Bulletin HPP-1, 10-78-AL, entitled "Elliott Speedblast Equipment is Versatile and Adaptable", (2 pages).

Hammelmann brochure, entitled "Operating and Assembly Instructions for Rotorjet", Copyrighted by Paul Hammelmann Maschinenfabrik GmbH, 09/85, (4 pages).

*Primary Examiner*—Andres Kashnikow
*Assistant Examiner*—Patrick N. Burkhart
*Attorney, Agent, or Firm*—Dykema Gossett

[57] ABSTRACT

The self-rotating nozzle has a hallow shaft adapted for connection to a source of pressurized fluid. A body has an axial bore upon a central axis secured over one end of the shaft and has a counterbore. The shank with an end portion extends from the body into which the counterbore extends with the counterbore terminating in a pair of radial ports. A head bears against the body and is journaled upon the shank. A fastener upon the end portion retains the head against axial movement relative to the body. A pair of spaced jet flow orifices are mounted upon outer portions of the head extending generally parallel to the central axis but on oppositely extending axes inclined at a small acute angle to axes parallel to the central axis to provide a balanced rotational reactive power torque to the head, there being a pair of fluid passages in the head communicating with the ports and with the orifices respectively, the orifices adapted to provide high velocity streams of pressurized fluid to a surface to be cleaned.

16 Claims, 1 Drawing Sheet

FIG. 1
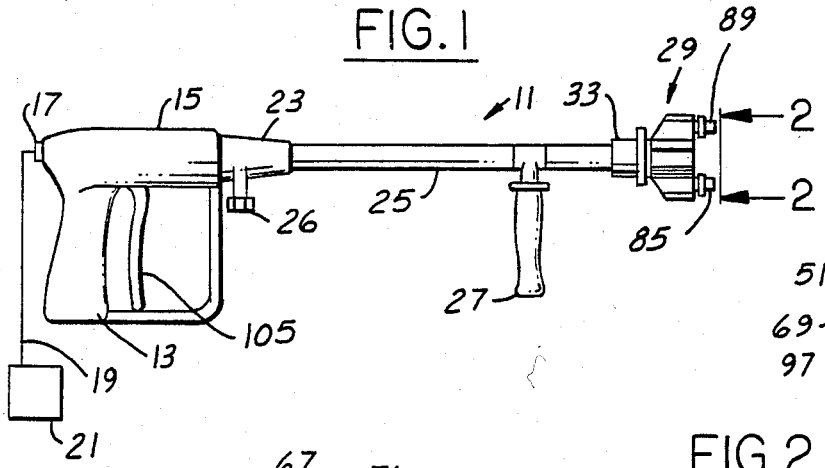
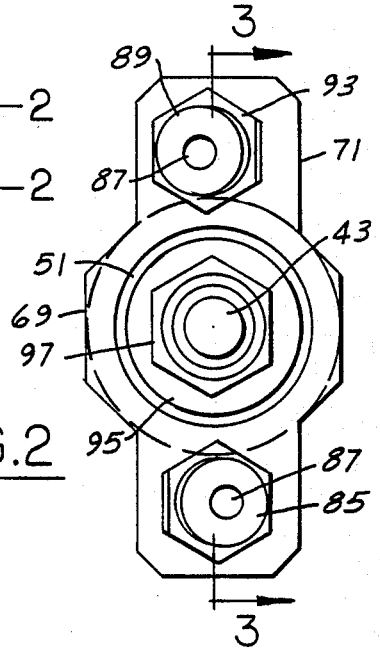
FIG. 2
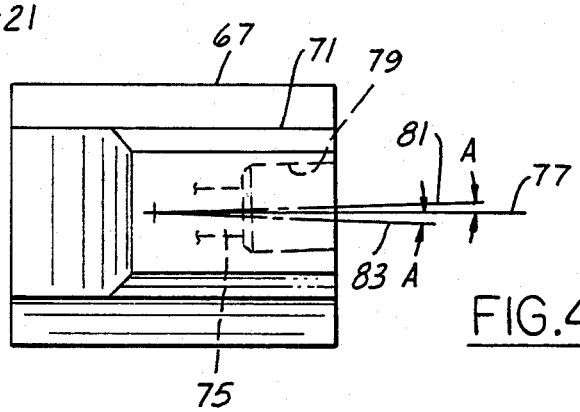
FIG. 4
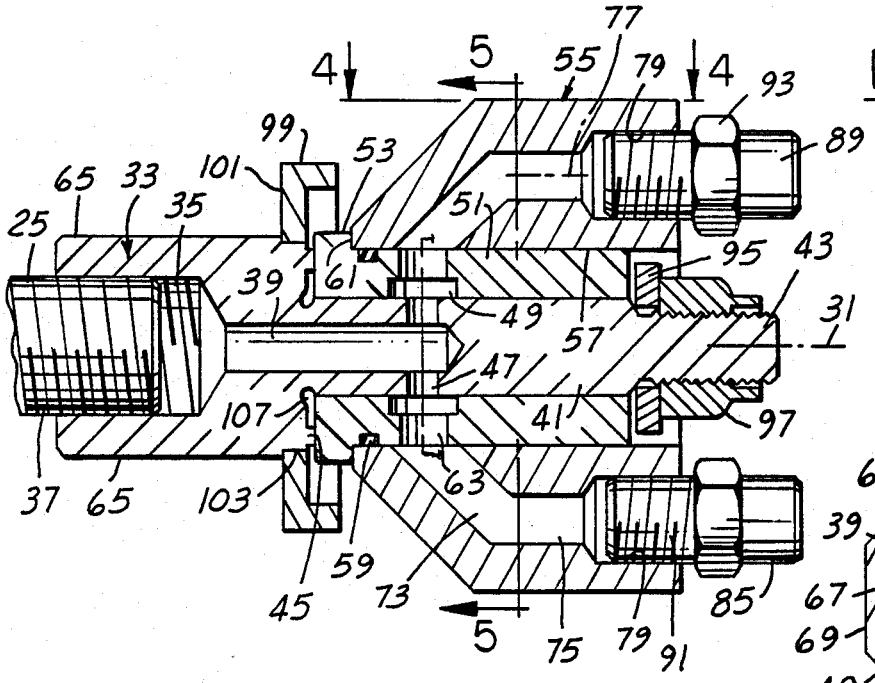
FIG. 3
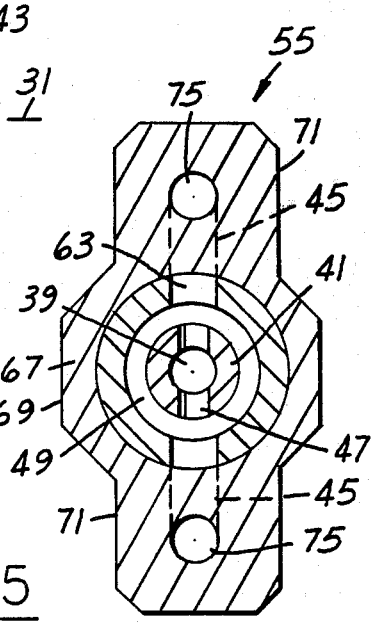
FIG. 5

SELF-ROTATING NOZZLE

FIELD OF INVENTION

The invention relates to hand-held rotative nozzles for delivering high-pressure, high-velocity fluids for impingement upon a surface to be cleaned.

SUMMARY OF THE INVENTION

The present invention relates to a self-rotating nozzle or nozzle assembly which is to be used on the end of a hand-held cleaning gun or lance for improving the speed or quality of cleaning a surface.

It is a feature of the present invention to provide an improvement in a self-rotating nozzle having a spinning head with a pair of orifices adapted for continuous rotation throughout 360 degrees.

Another feature of the present invention is to provide a self-rotating nozzle in which the spinning head has a pair of orifices adapted to be mounted upon a lance thereby improving the speed and/or quality of cleaning over a device using a single jet.

Still another feature of the present invention is to provide a self-rotating nozzle of the aforementioned type wherein the spinning head is adapted for rotation at approximately 3000 RPM and for delivery of high-velocity, high-pressure fluids up to 20,000 PSI upon a surface to be cleaned.

A further feature of the present invention is to provide a self-rotating nozzle of the aforementioned type in which the orifices are mounted upon outer portions of the spinning head generally parallel to the central axis of rotation but on oppositely extending axes inclined at an acute angle to axes parallel to the central axis of rotation of the head to thereby provide a self-rotating nozzle having a balanced rotational reactive power torque to the spinning head.

A still further feature of the present inention is to provide a selfrotating nozzle which is simple in construction, efficient in operation, and is economical to manufacture and to maintain.

These and other features and objects will be seen from the following specification and claims in conjunction with the appended drawings.

THE DRAWING

FIG. 1 is a side elevational view of the present self-rotating nozzle upon the end of a hand-held with pressurized hydraulic connections schematically shown.

FIG. 2 is an end view taken in the direction of arrows 2—2 of FIG. 1, on an increased scale.

FIG. 3 is a longitudinal section of the present self-rotating nozzle shown in FIG. 1, on an increased scale for clarity.

FIG. 4 is a fragmentary plan view taken in the direction of arrows 4—4 of FIG. 3.

FIG. 5 is a vertical section taken in the direction of arrows 5—5 of FIG. 3.

It will be understood that the above drawing illustrates a merely a preferred embodiment of the invention, and that other embodiments are contemplated within the scope of the claims hereafter set forth.

DETAILED DESCRIPTION OF AN EMBODIMENT OF THE INVENTION

A water blaster, apparatus or gun 11 is shown in FIG. 1 for mounting and supporting the present self-rotating nozzle assembly 29, FIG. 1, adapted to provide high-velocity streams of pressurized fluid upon a surface to be cleaned. The apparatus 11 includes a support grip 13 with overlying pressure chamber 15 having hose fitting 17 adapted for connection to a pressure hose 19 extending from pump and tank assembly 21, schematically shown in FIG. 1. The pump and tank assembly 21 includes a pump and a reservoir for delivering fluid, such as water, at pressures up to 20,000 PSI.

Pressure chamber 15 terminates in an outlet fitting 23 into which projects one end of a lance, wand or hollow shaft 25 which is suitably secured thereto, as by set screw 26 or other fastener.

Mounted upon the other end of the shafter or lance 25 is the present self-rotating nozzle or nozzle assembly 29 having a longitudinal axis of rotation 31, FIG. 3. The lance or support shaft 25 includes a depending handle 27 intermediate its ends which in conjunction with grip 13 provides a means for manually supporting the lance or hollow shaft 25 and for directing streams of pressurized fluid outwardly from the self-rotating nozzle assembly 29.

The nozzle assembly 29 includes a body 33 constructed of stainless steel having at one one an axial threaded bore 35 adapted to receive the threaded end 37 of shaft 25, fragmentarily shown, FIG. 3, and shown in assembly in FIG. 1. Threaded bore 35 terminates in an elongated counterbore 39 arranged upon the central axis 31. One end of body 33 terminates in an elongated shank 41, FIG. 3, into which projects one end of the counterbore 39. Shank 41 at one end terminates in a threaded end 43.

Body 33 at one end terminates in an annular stop flange 45. Counterbore 39 adjacent one end terminates in opposed inner radial ports 47. The ports 47 communicate with an annular channel 49 upon the interior of bushing 51. Busing 51 is rotatably journaled upon the shank 41 and includes an annular flange 53 in engagement with the annular stop flange 45. Bushing 51 is axially projected into and secured within head 55 or pressed therein. The head 55 is constructed of stainless steel.

The rotatable head 55 includes axial bore 57 into which bushing 51 is projected and secured with an O-ring seal 59 interposed. Instead of the O-ring 59, there could be employed a Loctite TM composition both forward and aft of the cross-drilled ports 63 within the bushing 51.

Head 55 at one end has an annular end face 61 in snug registry with flange 53 of bushing 51. The respective radial ports 47 communicating with counterbore 39 are in registry with annular channel 49 upon the interior of bushing 51. A pair of radial ports 63 extend from the annular channel 49 to the exterior of bushing 51 and are adapted for communication with the respective top and bottom orifices 89 and 85, FIG. 3. To facilitate mounting and anchoring of body 33 upon the wand 25, there are applied to opposite sides thereof a pair of wrench-engaging flats at an axial position on the wand identified by the numeral 65, FIG.

Head 55, rotatable upon axis 31, includes a central portion 67, FIG. 5, having a pair of opposed wrench-engaging flats 69 and a pair of diametrically opposed, outwardly-extending wings 71 which mount the respective orifies 85 and 89. Within central portion 69 of head 55 are a pair of angular passages 73, in the illusrated embodiment inclined at a 45 degree angle to axis 31. Passages 73 at their inner ends communicate with outboard radial ports 63 within busking 51. The outer ends of angular passages 73 terminate in axial passages 75 located within wings 71. Passages 75 are arranged upon longitudinal axes 77 which are parallel to central axis 31, each passage 75 terminating in an enlarged interiorly-threaded nozzle counterbore 79, FIG. 3.

As shown in FIG. 4, each of the respective counterbores 79 is arranged upon oppositely extending lateral axes 81 and 83, in the illustrative embodiment at an angle "A" of 1.7 degrees, approximately, relative to axis 77 of respective bores 75. Threaded bores 79 which receive respective orifices 85 and 89 are generally parallel to central axis 31, but are arranged upon oppositely extending axes 81 and 83, inclined at a small acute angle "A" to axis 77 parallel to central axis 31 in order to provide a balanced rotational reactive power torque to head 55. Acute angle "A" is in the range of 1 to 3 degrees, approximately. Bottom orifice 85 with a suitable fluid outlet 87 has a threaded shank 91 which is threaded into the corresponding lower threaded bore 79 as shown in FIG. 3. Top orifice 89 has a similar fluid outlet 87, and a corresponding threaded shank 91 is threaded into the top threaded bore 79, FIG. 3. Each of the respective orifices 85, 89 have intermediate their ends a hex nut 93 as a part thereof to facilitate threading and securing into the respective wings 71 forming a part of rotative head 55.

In the assembly shown in FIG. 3, apertured end plate 95 is mounted over the inner end of threaded end 43 of shank 41, is spaced from one end of bushing 51 and is retained on the threaded end 43 by adjustable fastener or nut 97.

Annular fluid deflector 101 is mounted against the shoulder 103 formed adjacent one end of body 33 and includes an axial annular flange 99 which extends over stop flange 53 forming a part of bushing 51. Annular stop flange 45 at one end of body 33 in cooperation with end flange 53 and bushing 51 defines a pressure chamber 107. Outletting pressurized fluids, such as water, pass radially outward through radial ports 47 for direction to the annular passage 49 in bushing 51 and through radial ports 63 to passages 73 and 75 for supplying pressurized fluid at high velocity to the respective nozzles 85 and 89.

Since there is some limited spacing between the rotatable bushing 51 upon head 55 with respect to shank 41, the pressurized fluid passes upon the bore of bushign 51 moving into pressure chamber 107 to normally bias bushing 51 axially outward. Additional pressurized fluid passes in the opposite direction between shank 41 and bushing 51 to lubricate bushing 51 during its rotation with respect to the shank 41. No packing is required. Any pressurized fluid which escapes from pressure chamber 107 moves radially outward into fluid deflector 101 for projecting axially forward towards the rotating head 55.

Due to the angular opposing relationship of the respective orifices 85 and 89 with respect to corresponding central axes 77 parallel to central axis 31, there is established upon full flow of fluids through the orifices a rotational reactive power torque to head 55 for rotation about axis 31 and with respect to shank 41 upon body 33.

The respective fluid passages 73 and 75 within the head communicate with the radial ports 63 in the bushing 51 and further communicate with the respective orifices 85 and 89 to provide high-velocity streams of pressurized fluid upon a surface to be cleaned. In the illustrated embodiment pressure fluids are developed up to 20,000 PSI. The self-rotating nozzle assembly rotates at full speed at approximately 3000 RPM.

The present self-rotating nozzles when normally arranged upon one end of a cleaning gun or lance, such as shown at 25, improves the speed and quality of cleaning over the use of a single jet.

Having described my invention, reference should now be had to the following claims.

I claim:

1. A self-rotating nozzle comprising a hollow shaft adapted for connection to a source of pressurized fluid;

a body having an axial bore upon a central axis secured over one end of said shaft, and having a counterbore;

a shank extending from said body in which said counterbore extends;

said counterbore terminating in a pair of opposed inner radial ports;

an end portion on one end of the shank;

a head bearing against said body and journaled upon said shank for rotation upon the central axis;

fastener means upon said shank end portion retaining said head against axial movement in one direction relative to said body;

a pair of spaced jet flow orifices mounted upon outer portions of said head extending generally parallel to said central axis but on oppositely extending axes inclined at a small acute angle to axes parallel to said central axis to provide a balanced rotational reactive power torque to said head;

a pair of fluid passages in said head communicating with said orifices, said orifices adapted to provide high-velocity streams of pressurized fluid upon a surface to be cleaned;

the journal of said head upon the shank including a bushing axially extending into said head and fixed thereto;

an annular groove in said bushing communicating with said inner radial ports;

a pair of outer radial ports in said bushing connecting said annular grove of said bushing and said fluid passages; and an annular flange projecting radially from said body and secured thereto, said annular flange operably engaging said head at the second axial direction relative to said body;

pressure fluids from said inner radial ports escaping axially along said shank and head for lubricating the head;

said annular flange with said head defining a pressure chamber acting upon one end of said head to bias the head towards said shank end portion.

2. In the self-rotating nozzle of claim 1, the acute angle of each of said orifices being equal for uniform recoil action to said head.

3. In the self-rotating nozzle of claim 1, the acute angle of each of said orifices being in the range of 1 to 3 degrees, approximately.

4. In the self-rotating nozzle of claim 1, the acute angle of each of said orifices being 1.7 degrees approximately.

5. In the self-rotating nozzle of claim 1, said hollow shaft being a wand having a support grip at one end of the wand and a handle intermediate its ends.

6. In the self-rotating nozzle of claim 1, said fastener means including an apertured end plate mounted upon said shank end portion adjacent said bushing; and a fastener mounted upon said end portion retainingly engaging said end plate.

7. In the self-rotating nozzle of claim 6, said end portion being threaded.

8. In the self-rotating nozzle of claim 1, said bushing being pressurefitted into said head for rotation therewith.

9. In the self-rotating nozzle of claim 1, said head including a central portion and a pair of diametrically opposed radial wings extending from said central portion;

there being a pair of spaced threaded bores within outer portions of said wings respectively generally parallel to said central axis, but on oppositely extending axes inclined at a small acute angle to axes parallel to the central axis;

said orifices being threaded into said bores respectively.

10. In the self-rotating nozzle of claim 9, said fluid passages including for each orifice axial outboard passage communicating with a threaded bore and an inclined passage extending to a radial port.

11. In the self-rotating nozzle of claim 1, said head including a central portion and a pair of diametrically opposed radial wings extending from said central portion;

there being a pair of spaced threaded bores within outer portions of said wings respectively generally parallel to said central axis, but on oppositely extending axes inclined at a small acute angle to axes parallel to the central axis;

said orifices being threaded into said bores respectively.

12. In the self-rotating nozzle of claim 11, said fluid passages including for each orifice an axial outboard passage communicating with a threaded bore, and an inclined passage extending from said axial passage to a radial port in said bushing.

13. In the self-rotating nozzle of claim 1, and an annular fluid deflector mounted over one end of said body having a axial flange extending towards said head.

14. A self-rotating nozzle comprising a hollow shaft adapted for connection to a source of pressurized fluid;

a body having an axial bore upon a central axis secured over one end of said shaft, and having a counterbore;

a shank extending from said body in which said counterbore extends;

said counterbore terminating in a pair of opposed inner radial ports;

an end portion on one end of the shank;

a head bearing against said body and journaled upon said shank for rotation upon the central axis;

fastener means upon said shank end portion retaining said head against axial movement in one direction relative to said body;

a pair of spaced jet flow orifices mounted upon outer portions of said head extending generally parallel to said central axis but on oppositely extending axes inclined at a small acute angle to axes parallel to said central axis to provide a balanced rotational reactive power torque to said head;

a pair of fluid passages in said head at their one ends communicating with said radial ports and at their other ends communicating with said orifices, said orifices adapted to provide high-velocity streams of pressurized fluid upon a surface to be cleaned;

an annular flange projecting radially from said body and secured thereto, said annular flange operably engaging said head at the second axial direction relative to said body;

pressure fluids from said inner radial ports escaping axially along said shank and head for lubricating the head;

said annular flange with said head defining a pressure chamber acting upon one end of said head to bias the head towards said shank end portion.

15. A self-rotating nozzle as recited in claim 14 and said head including:

a bushing member fixed on the inner periphery of said head to ride on said shank;

said bushing member having an inner annular groove communicating with said inner radial ports and a pair of outer radial ports in said bushing connecting said annular groove and said orifice passages;

said bushing member being the portion of said head defining the pressure chamber with said annular flange.

16. A self-rotating nozzle comprising a hollow shaft adapted for connection to a source of pressurized fluid;

a body having an axial bore upon a central axis secured over one end of said shaft, and having a counterbore;

a shank extending from said body in which said counterbore extends;

said counterbore terminating in at least one inner radial port;

an end portion on one end of the shank;

a head bearing against said body and journaled upon said shank for rotation upon the central axis;

fastener means upon said shank end portion retaining said head against axial movement in one direction relative to said body;

at least one jet flow orifice mounted upon outer portions of said head extending generally parallel to said central axis inclined at a small acute angle to axes parallel to said central axis to provide a rotational reactive power torque to said head;

at least one fluid passage in said head at one end communicating with said radial port and at the other end communicating with said orifice, said orifice adapted to provide high-velocity streams of pressurized fluid upon a surface to be cleanede;

an annular flange projecting radially from said body and secured thereto, said annular flange operably engaging said head at the second axial direction relative to said body;

pressure fluids from said inner radial ports escaping axially along said shank and head for lubricating the head;

said annular flange with said head defining a pressure chamber acting upon one end of said head to bias the head towards said shank end portion.

* * * * *
* * * * *

UNITED STATES PATENT AND TRADEMARK OFFICE

CERTIFICATE OF CORRECTION

PATENT NO. : 4,821,961

DATED : April 18, 1989

INVENTOR(S) : Forrest A. Shook and Terry L. Henshaw

It is certified that error appears in the above-identified patent and that said Letters Patent is hereby corrected as shown below:

Title page, Item [75]: Terry L. Henshaw, Battle Creek, Mich., should be added as a joint inventor.

Item [19], "Shook" should read --Shook et al--

In the Abstract, Line 17, cancel "the ports" and substitute --the radial ports--.

Column 1, Line 38, cancel "inention" and substitute --invention--.

Column 1, Line 40, cancel "selfrotating" and substitute --self-rotating--.

Column 1, Line 48, cancel "hand-held with" and substitute --hand-held wand with--.

Column 1, Line 60, cancel "a merely".

Column 2, Line 13, cancel "shafter" and substitute --shaft--.

Column 2, Line 37, cancel "Busing" and substitute --Bushing--.

Column 2, Line 60, cancel "FIG." and substitute --FIG. 3.--.

Column 3, Line 47, cancel "bushign" and substitute --bushing--.

UNITED STATES PATENT AND TRADEMARK OFFICE

CERTIFICATE OF CORRECTION

PATENT NO. : 4,821,961

DATED : April 18, 1989

INVENTOR(S) : Forrest A. Shook and Terry L. Henshaw

It is certified that error appears in the above-identified patent and that said Letters Patent is hereby corrected as shown below:

Column 4, Line 8, cancel "my" and substitute --our--.

Signed and Sealed this

Sixth Day of February, 1990

*Attest:*

JEFFREY M. SAMUELS

*Attesting Officer*

*Acting Commissioner of Patents and Trademarks*